US005310313A

United States Patent [19]

Chen

[11] Patent Number: 5,310,313

[45] Date of Patent: May 10, 1994

[54] SWINGING TYPE OF ELECTRIC FAN

[76] Inventor: C. H. Chen, 12, Lane 296, Sec. 3, Chung-Ching North Road, Taipei, Taiwan

[21] Appl. No.: 980,567

[22] Filed: Nov. 23, 1992

[51] Int. Cl.[5] ..... F04D 29/36

[52] U.S. Cl. ..... 416/100; 416/110; 416/116

[58] Field of Search ..... 416/100, 108, 106, 110, 416/113, 116; 417/423.7, 423.1

[56] References Cited

U.S. PATENT DOCUMENTS

| | | | |
|---|---|---|---|
| 1,994,914 | 3/1935 | Jordan | 416/100 |
| 4,186,313 | 1/1980 | Wurtz | 416/116 |
| 4,703,152 | 10/1987 | Shih-Chin | 416/110 |
| 5,013,224 | 5/1991 | Liao | 417/423.1 |

*Primary Examiner*—Edward K. Look
*Assistant Examiner*—Mark Sgantzos
*Attorney, Agent, or Firm*—Pro-Techtor International

[57] ABSTRACT

A swiveling electric fan comprising a truncated sphere-shaped housing which encloses a vane member, and a base having a concave spheric top surface with the same diameter as that of the housing, the housing being connected with the base in a swiveling manner, an upper end of the supporting disk being secured to the housing while a lower end thereof extending into the base to connect with and abut against a rotary guiding disk of a swiveling mechanism in a swiveling manner, so that when the guiding disk rotates, a sleeve section of the supporting disk is rotated in a circular hole of the top surface of the base, the circular hole being larger than the sleeve section in diameter, whereby the vane member is made to swivel through an elliptical trace.

5 Claims, 6 Drawing Sheets

SWINGING TYPE OF ELECTRIC FAN

BACKGROUND OF THE INVENTION

The present invention is related to a swiveling electric fan, and more particularly to an electric fan having a truncated sphere-shaped housing and a base having a concave spheric top surface with the same diameter as that of the housing. The housing and a vane member disposed therein are supported by a supporting disk on a rotary guiding disk of a swiveling mechanism disposed in the base, whereby a sleeve section of the supporting disk rotates in a relatively large circular hole of the top surface of the base so as to make the vane member elliptically swivel. The swiveling mechanism used in the fan is very simple and the drawbacks existing in a conventional oscillating mechanism employing engaged gears are eliminated. Therefore, the using life of the fan according to this invention is much longer than that of conventional one and the production efficiency and convenience in use are greatly increased.

It is well known that a conventional oscillating electric fan includes a gear set connected with an output shaft of a driving motor to make the fan oscillate. In such arrangement, the oscillating angle is often limited by the housing enclosing the vanes and the gear set is liable to break apart and fail when overloaded or overoscillated or improperly oscillated.

Therefore, in the current oscillating mechanism of the electric fan, the oscillating motor and the driving motor for the vanes are independently disposed. However, the transmission thereof still includes a complex set of gears. The assembly thereof is troublesome and the gears are made of plastic material which has poor mechanical strength. As a consequence, the gears tend to break apart after a period of use or when improperly used.

SUMMARY OF THE INVENTION

It is therefore a primary object of this invention to provide a swiveling type of electric fan in which a swiveling mechanism is disposed in a base, having a rotary guiding disk driven by an independent motor. A supporting disk connects with and abuts against the guiding disk in a swiveling manner, whereby when the guiding disk rotates the supporting disk swivels so as to drive the housing and the vanes to elliptically swivel. According to the above arrangement, the drawbacks of a conventional oscillating mechanism employing engaged gears are eliminated.

It is a further object of this invention to provide the above electric fan in which the swiveling mechanism is freely positioned by the user and a lower end of the sleeve section of the supporting disk is guided into a recess of a stopper of the guiding disk by a guiding groove thereof without failure.

It is still a further object of this invention to provide the above electric fan in which the swiveling mechanism includes no gear and the components thereof are simple and the assembly thereof is easy so that the labor and time are saved and the production efficiency is increased.

The present invention can be best understood through the following description and accompanying drawings, wherein:

DETAILED DESCRIPTION OF THE PREFERRED EMBODIMENTS

Figure 1:
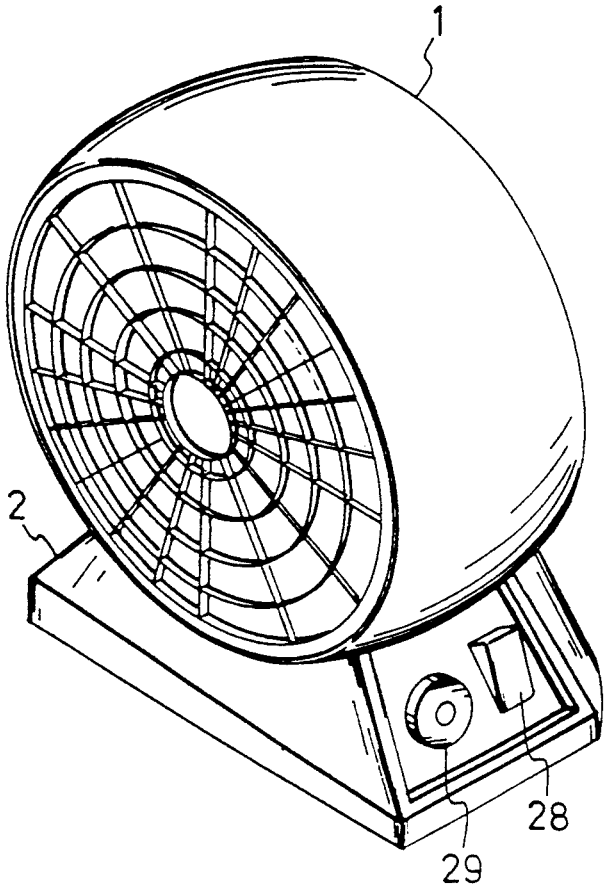
FIG. 1 is an assembled perspective view of a preferred embodiment of this invention.
Figure 2:
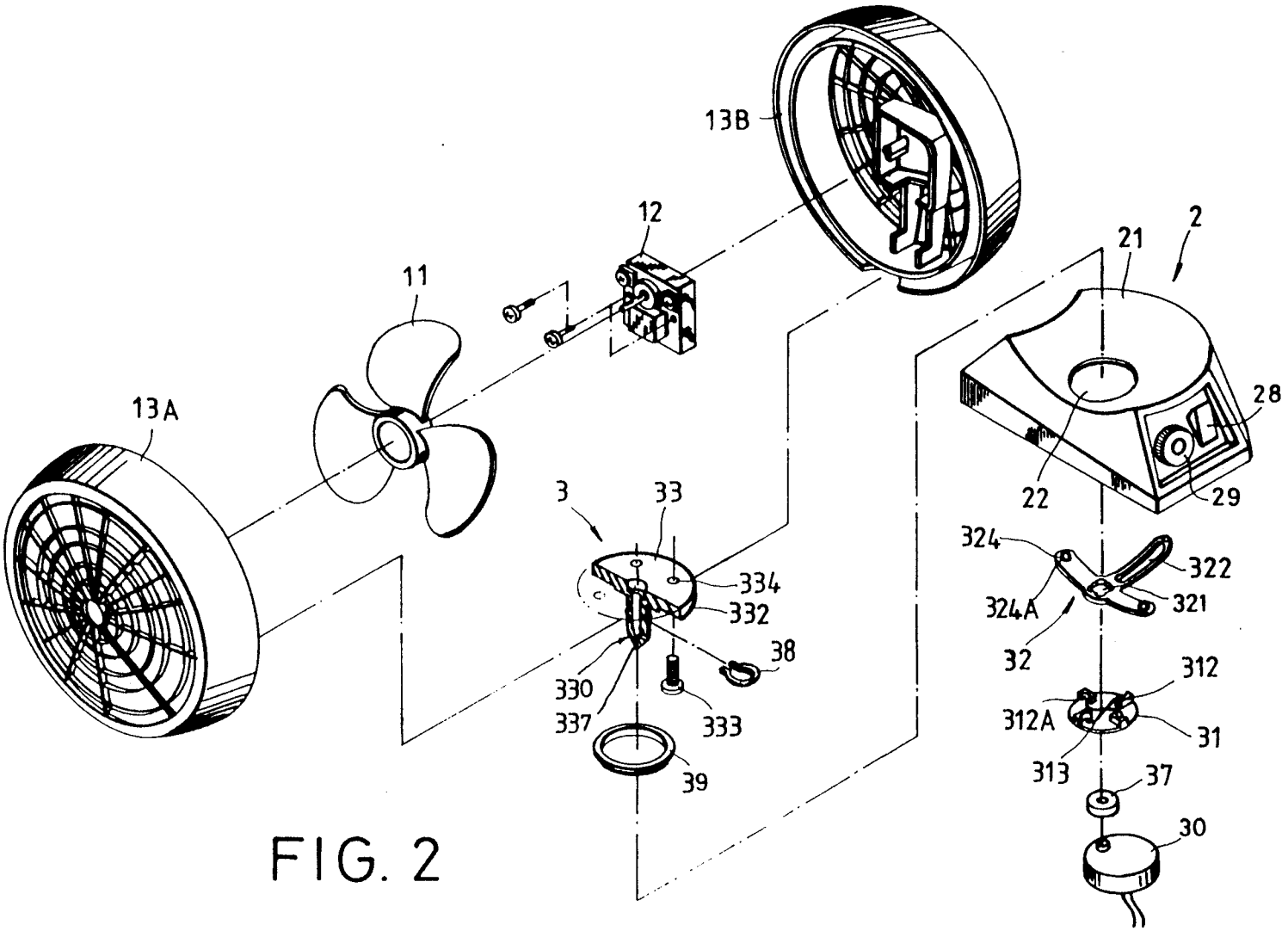
FIG. 2 is an exploded perspective view thereof.
Figure 3:
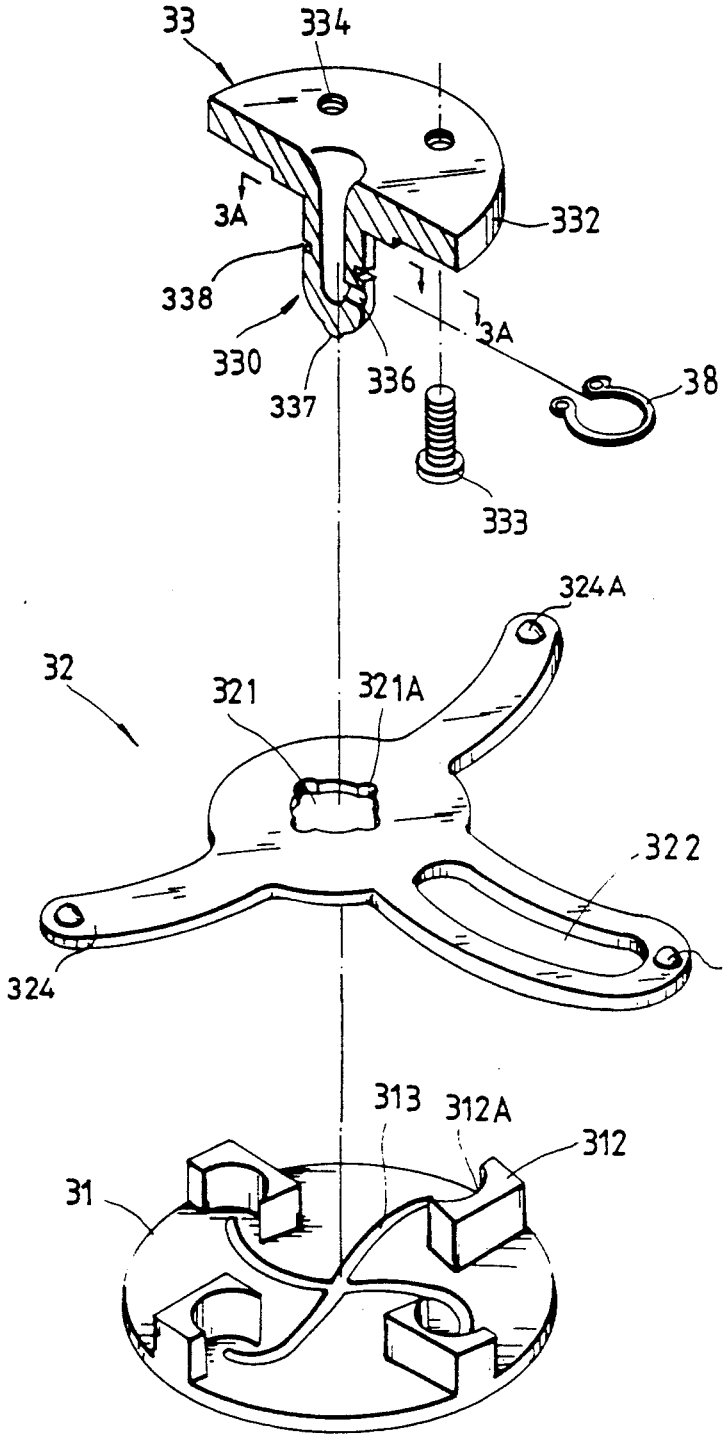
FIG. 3 is an enlarged perspective view of the main components of the tilting mechanism thereof.

Please refer to FIGS. 1 to 3. The swiveling electric fan of this invention mainly includes a fan main body 1, a base 2 and a swiveling mechanism 3. As shown in FIG. 2, the fan main body 1 includes a vane member 11, a fan motor 12 for driving the vane member 11 and a substantially spheric housing 13 for enclosing the vane member 11. The housing 13 is composed of a front section 13A and a rear section 13B associated therewith by screws (not shown).

The base 2 has a concave top surface 21 which is shaped corresponding to the spheric housing 13. A central circular hole 22 is formed on the top surface 21. The base 2 is hollow for housing the swiveling mechanism 3 and a swiveling motor 30 for driving the swiveling mechanism 3. The swiveling mechanism 3 supports the fan main body 1 above the base 2 and swivels the fan main body 1 through an elliptic trace. In addition, a power switch 28 and a speed adjusting switch 29 are disposed on one side of the base 2 to respectively control the power of the vane-driving motor 12 and the swiveling motor 30 and adjust the rotational speed of the fan.

Please now refer to FIGS. 2, 3, 3A, 4A and 4B. The swiveling mechanism 3 includes a guiding disk 31, an arch guiding member 32 and a supporting disk 33. The motor 30 is secured in the base 2 by means of two posts 24 downward extending from an inner top surface of the base 2 and a securing plate 36. A rotary shaft 301 of the motor 30 goes through an opening of the securing plate 36 into a sleeve section 311 of the guiding disk 31 and fixedly connects therewith. A bearing 37 is disposed between the sleeve section 311 of the guiding disk 31 and a wall of the opening of the securing plate 36 for reducing the frictional force therebetween, whereby the guiding disk 31 and the motor 30 can rotate synchronously and smoothly.

Figure 4A:
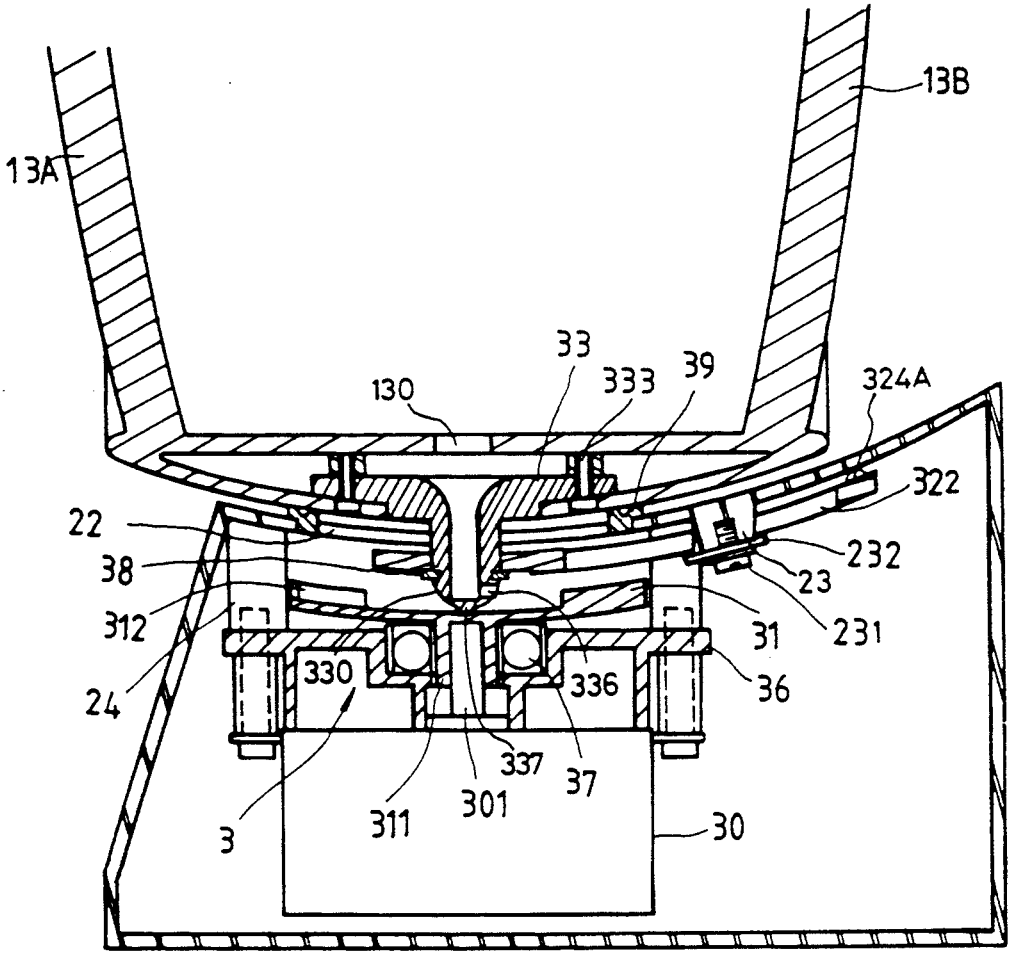
FIGS. 4A and 4B are side sectional views showing the operation thereof.

Please now refer to FIG. 3. More than one stopper 312 (four stoppers 312 are disposed in this embodiment) and corresponding guiding grooves 313 are disposed on the guiding disk 31 for guiding a lower end 337 of a sleeve section 330 of the supporting disk 33 through the guiding grooves 313 into recesses 312A of the stoppers 312 so as to create swiveling movement of the fan as will be discussed in detail hereinafter. A disk member 332 of the supporting disk 33 is secured on a bottom of the housing 1 by screws 333 which go through four holes 334 of the disk member 332 (as shown in FIG. 4A). The sleeve section 330 of the supporting disk 33 extends through a gasket 39 into the base 2. The sleeve 39 is disposed in the circular hole 22 of the top surface 21 of the base. A C-shaped fastening ring 38 is fixed in an annular fixing recess 338 disposed at a middle portion of the sleeve section 330 of the supporting disk 33 under a central circular hole 321 of the arch guiding member 32 disposed under the inner top surface of the base, so that a lower portion 337 of the sleeve section 330 of the supporting disk 33 engages with and abuts against the guiding disk 31 in a swiveling manner so as to bear the weight of the fan and rotate along with the guiding disk 31 for swiveling the fan.

Figure 3A:
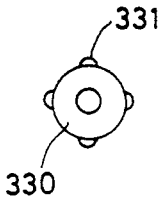
FIG. 3A is a bottom plan view of the sleeve section of the supporting disk of this invention.

As shown in FIGS. 3 and 4, the sleeve section 330 of the supporting disk 33 has several peripheral symmetric projections 331 (see FIG. 3A). The projections 331 and the annular fixing recess 338 are disposed respectively in accordance with the recesses 321A of the central hole 321 of the arch guiding member 32 and the C-shaped fastening ring 38, whereby the supporting disk 33 is tightly engaged with the arch guiding member 32 as an integral body without slipping, and thus the supporting disk 33 connects with and abuts against the guiding disk 32 in a swiveling manner in order to drive the arch guiding member 32 and swivel the fan. A restricting pin 23 (see FIG. 4A) downward extends from the inner top surface of the base 2 and goes into an arch guiding slot 322 of the arch guiding member 32 to be secured thereto by a screw 231 and a washer 232. Furthermore, for reducing frictional force between the arch guiding member 32 and the base 2, several protuberances or ball members 324A are disposed on two ends of two arm portions 324 of the arch guiding member 32. If necessary, a distal end of the arch guiding slot 322 is also provided with a protuberance to more smoothly control the swiveling angle of the fan.

In addition, the gasket 39 fitted in the circular hole 22 of the top surface 21 of the base 2 is made of hard plastic material for supporting the housing 1. Such material creates lubricant effect so as to reduce the frictional resistance between the bottom of the housing 1 and the spheric top surface 21 of the base 2. Moreover, the gasket 39 serves to share the weight of the fan main body 1 with the supporting disk 33. In addition, an inner diameter of the circular hole 22 of the top surface 21 is larger than an outer diameter of the sleeve section 330 of the supporting disk 33, and the sliding travel of the guiding slot 322 of the arch guiding member 32 is limited by the restricting pin 23 of the base 2, so that the sleeve section 330 of the supporting disk 33 is freely rotatable within the circular hole 22 of the base 2 with the lower end 337 of the sleeve section 330 prevented from sliding out of the guiding disk 31, permitting a user to freely position the swiveling mechanism 3 via the housing 13, with the lower end 337 of the sleeve section 330 sliding into the recess 312A of the stopper 312 by means of the guiding of the guiding groove 313 and the stopper 312, whereby the fan main body 1 is permitted to swivel through an elliptical trace without failure (as shown in FIGS. 5A to 5C).

Moreover, for keeping the fan powered on during the movement of the supporting disk 33, near the lower end 337 of the sleeve section 330 of the supporting disk 33 is disposed a wire entrance hole 336 communicating with an axial hole of the sleeve section 330, so that an electric wire inside the base 2 can be extended through the entrance hole 336, the axial hole of the sleeve section 330 and a bottom hole 130 of the housing 13 toward the fan motor 12 and swiveling motor 30.

Figure 4B:
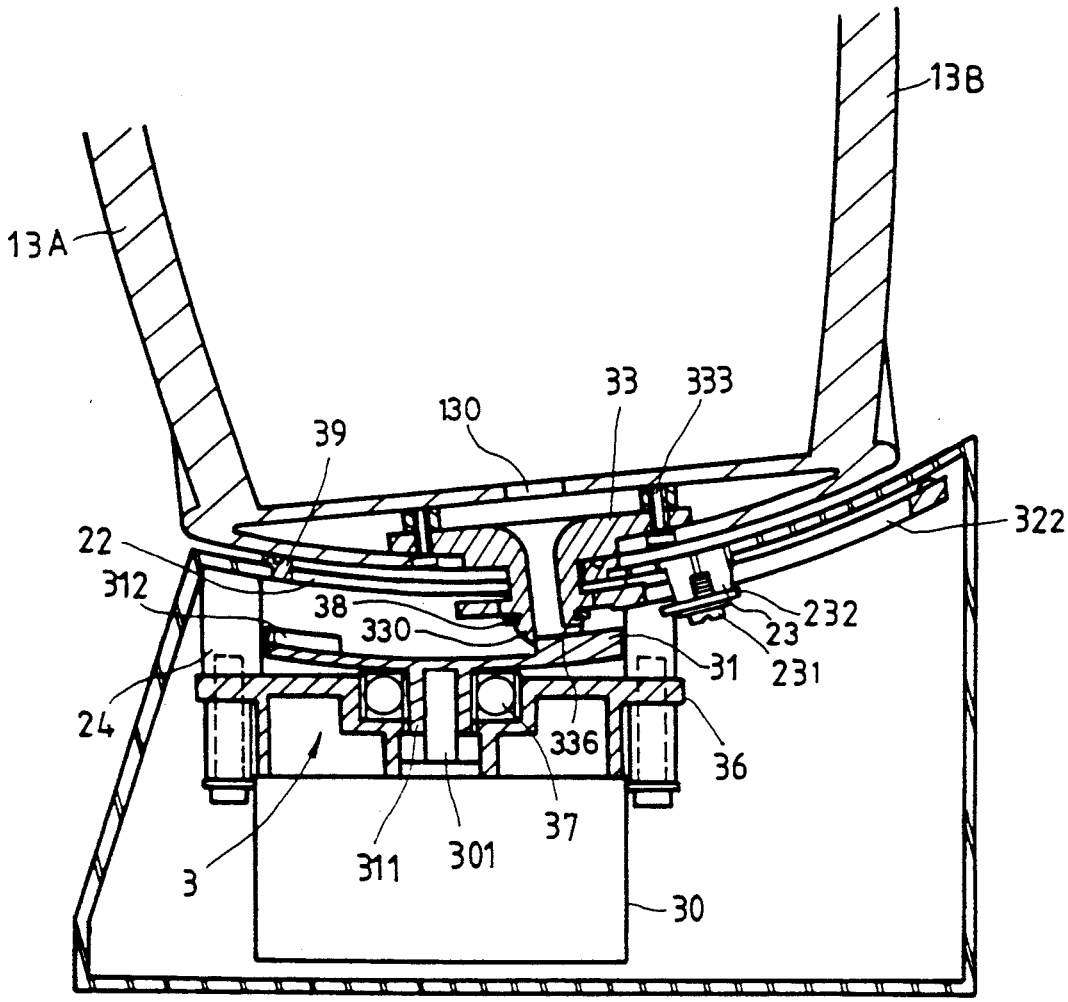
Figure 5B:
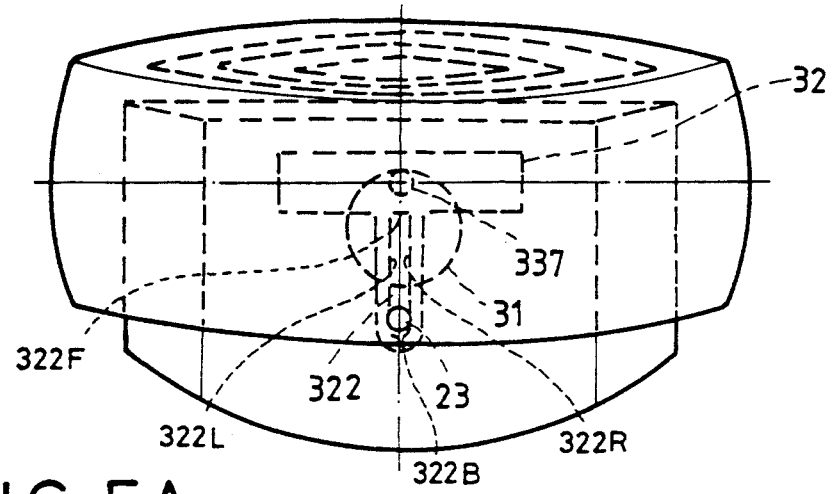
FIGS. 5A to 5C show the swiveling movement of this invention.
Figure 5A:
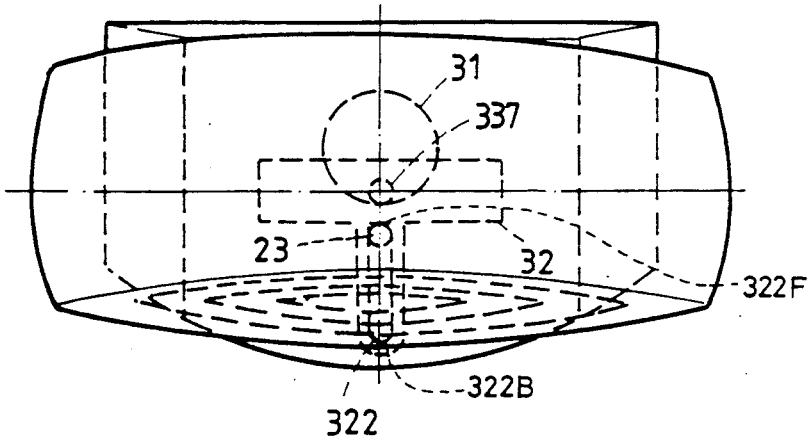
Figure 5C:
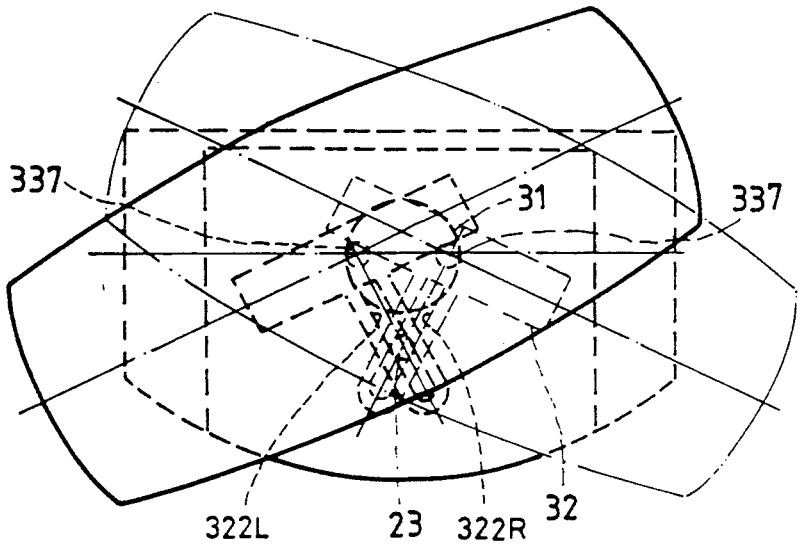

Please now refer to FIGS. 5A to 5C which illustrate the swiveling movement of the fan. For simplification, the supporting disk 33 is represented by the lower end 337 thereof and the arch guiding member 32 is represented by a T-shaped member. A left side of the guiding slot 322 is denoted by "322L", a right side thereof is denoted by "322R", a front side thereof is denoted by "322F" and a back side thereof is denoted by "322B". As shown in FIG. 5A, when the guiding disk 31 is rotated, the lower end 337 of the supporting disk 33 is guided from a central portion of the guiding disk 31 through the guiding groove 313 into the recess 312A of the peripheral stopper 312 of the guiding disk 31 as shown in FIGS. 4A and 4B. Meanwhile, the lower end 337 of the supporting disk 33 moves backward and simultaneously the arch guiding board 32 along with the supporting disk 33 moves backward to a greatest extent, making the front side 322F of the guiding slot 322 abut against the restricting pin 23 of the base 2. In addition, because the sleeve section 330 of the supporting disk 33 is restricted within the gasket 39, the lower end 337 of the supporting disk 33 is restricted to slide on the guiding disk 31 within the periphery thereof, as shown in FIG. 4B. As a result, the fan main body 1 is tilted forward to a rear end point of a long axis of the elliptical trace of the swiveling movement of the fan. Similarly, when the guiding disk 31 continuously rotates, the lower end 337 of the supporting disk 33 turns to move leftward toward a left end of the guiding disk 31 as shown in FIG. 5C. At this time, the supporting disk 33 and the arch guiding member 32 together move leftward, making the right side 322R of the guiding slot 322 abut against the restricting pin 23. Therefore, the fan main body 1 is tilted leftward to a left end point of a short axis of the elliptical trace of the swiveling movement of the fan, as shown by solid line of FIG. 5C. Similarly, when the guiding disk 31 continues to rotate, the lower end 337 of the supporting disk 33 turns to move forward as shown in FIG. 5B. At this time, the supporting disk 33 and the arch guiding member 32 together move forward to a greatest extent, making the back side 322B of the guiding slot 322 abut against the restricting pin 23. Meanwhile, the lower end 337 is located at a front end of the guiding disk 31. As a result, the fan main body 1 is tilted backward to a front end point of the long axis of the elliptical trace of the swiveling movement of the fan, as shown in FIG. 5B. Still similarly, when the guiding disk 31 continues to rotate, the lower end 337 turns to move rightward as shown by phantom line in FIG. 5C. At this time, the supporting disk 33 and the arch guiding member 32 together move rightward to a greatest extent, making the left side 322L of the guiding slot 322 abut against the restricting pin 23. Meanwhile, the lower end 337 is located at a right end of the guiding disk 31. As a result, the fan main body 1 is tilted rightward to a right end point of the short axis of the elliptic trace of the swiveling movement of the fan, as shown by the phantom line in FIG. 5C. According to such periodic movement, the guiding slot 322 of the arch guiding member 32 and the restricting pin 23 of the base 2 will restrict the swiveling travel of the fan and make the same swivel through an elliptical trace. Since the diameter of the circular hole 22 of the base 2 is larger than the outer diameter of the sleeve section 330 of the supporting disk 33, and the diameter of the guiding disk 31 is larger than the outer diameter of the sleeve section 330 of the supporting disk 33, the same is freely rotatable within the guiding disk 31 without separating therefrom. As a consequence, the movement of fan of this invention is forward, leftward, backward and rightward tiltable to form a continuously elliptically swiveling trace.

What is claimed is:

1. A swiveling electric fan comprising:

a housing comprised of a front section and a rear section associated therewith, a vane member driven by a first motor disposed in said housing, said housing having the shape of a truncated sphere;

a base having a concave top surface with a diameter equal to that of a bottom section of said housing, a circular hole being in said top surface of said housing, a downward extending restricting pin being disposed on an inner side of said top surface of said base between said circular hole and a rear wall of said base;

a swiveling mechanism including a second motor fixed in said base having an upward extending rotary shaft, and further including a guiding disk member having a downward extending sleeve section and a disk section formed with a plurality of guiding means, said sleeve section of said guiding disk member being fixedly fitted with said rotary shaft of said second motor, so that said guiding disk member is rotated by said second motor, an arch guiding board member formed with a central insert hole, and having a laterally extending arch guiding slot, said restricting pin of said base being extended through said guiding slot, causing said guiding slot to slide along the circumference of the circular hole in the top surface of said base in an elliptical pattern, a supporting disk member having a disk section and a sleeve section extending downward therefrom, said disk section being secured under said bottom section of said housing while said sleeve section of said supporting disk member extends through said central insert hole of the arch guiding member, a lower end of said sleeve abutting against and engaging with the guiding disk so as to bear the weight of the fan and rotate when the guiding disk is rotated, thus causing the fan to swivel, the construction of said swiveling mechanism causing the fan to rotate in more than one plane of motion.

2. A swiveling electric fan as claimed in claim 1 wherein:

said insert hole in said arch guiding member is formed with several securing recesses, and wherein said sleeve section of said support disk member is formed with corresponding protuberances so that said arch guiding board member and said supporting disk member are securely affixed to each other so that they rotate together without slippage.

3. A swiveling electric fan as claimed in claim 1 wherein:

said guiding means of said disk section of said guiding disk member includes at least one guiding groove and more than one stopper, each of said stoppers having a recess for engaging said lower end of said sleeve section of said supporting disk member.

4. A swiveling electric fan as claimed in claim 1 wherein:

a C-shaped fastening ring is disposed under said central insert hole of said arch guiding board member, said C-shaped fastening ring being engaged with an annular groove of said sleeve section of said supporting disk member.

5. A swiveling electric fan as claimed in claim 1 wherein:

said circular hole in said top surface of said base includes an abrasion resistant and lubricated gasket so as to reduce friction between said bottom section of said housing and said top surface of said base.

* * * * *